US006490228B2

(12) United States Patent
Killam

(10) Patent No.: US 6,490,228 B2
(45) Date of Patent: Dec. 3, 2002

(54) APPARATUS AND METHOD OF FORMING ELECTRICAL CONNECTIONS TO AN ACOUSTIC TRANSDUCER

(75) Inventor: Donald Gilbert Killam, Woodinville, WA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/788,122

(22) Filed: Feb. 16, 2001

(65) Prior Publication Data

US 2002/0114217 A1 Aug. 22, 2002

(51) Int. Cl.[7] ..... H04R 1/06
(52) U.S. Cl. ..... 367/140
(58) Field of Search ..... 367/140, 152, 367/153; 310/336, 332, 330

(56) References Cited

U.S. PATENT DOCUMENTS 4,786,837 A * 11/1988 Kalnin et al. ..... 310/330
5,044,370 A * 9/1991 Dubut et al. ..... 310/336
6,043,590 A 3/2000 Gilmore ..... 310/367

* cited by examiner

*Primary Examiner*—Daniel T. Pihulic
(74) *Attorney, Agent, or Firm*—Dorsey & Whitney LLP

(57) ABSTRACT

An apparatus and method for forming electrical connections in an acoustic transducer wherein a non-conductive bonding material is interposed between a conductive surface on the transducer and a conductive lead. In one embodiment, the conductive surface is comprised of gold, and the conductive lead is comprised of copper that is plated with at least one metallic layer. The metallic layer may be further comprised of an intermediate metal layer that is overlaid by a layer of gold. The intermediate layer may be further comprised of titanium, or an alloy of nickel and chromium. A non-conductive bonding material is deposited on either the lead or the conductive surface, which are joined to form a bonding interface. Electrical conduction is attained through a plurality of contact points that arise from the surface roughness inherent in the materials that project through the bonding interface. Alternatively, the contact points are impressed in the surfaces.

71 Claims, 4 Drawing Sheets

APPARATUS AND METHOD OF FORMING ELECTRICAL CONNECTIONS TO AN ACOUSTIC TRANSDUCER

TECHNICAL FIELD

This invention relates generally to ultrasonic diagnostic systems that use ultrasonic transducers to provide diagnostic information concerning the interior of the body through ultrasonic imaging, and more particularly, to an apparatus and method of forming electrical connections to transducers used in such systems.

BACKGROUND OF THE INVENTION

Ultrasonic diagnostic imaging systems are in widespread use for performing ultrasonic imaging and measurements. For example, cardiologists, radiologists, and obstetricians use ultrasonic diagnostic imaging systems to examine the heart, various abdominal organs, or a developing fetus, respectively. In general, imaging information is obtained by these systems by placing a scanhead against the skin of a patient, and actuating an ultrasonic transducer located within the scanhead to transmit ultrasonic energy through the skin and into the body of the patient. In response to the transmission of ultrasonic energy into the body, ultrasonic echoes emanate from the interior structure of the body. The returning acoustic echoes are converted into electrical signals by the transducer in the scanhead, which are transferred to the diagnostic system by a cable coupling the diagnostic system to the scanhead.

The acoustic transducer is a piezoelectric element that is generally made of a crystalline material such as barium titanate, or lead zirconate titanate (PZT). The transducer may be a single element, or it may consist of a single piece of piezoelectric material that is cut, or diced into an array of fine elements, with the individual elements of the array transducer generally being rectangular in shape. Array scanheads are operable in ultrasonic scanning modes known as linear array and phased array modes, in which groups of elements are actuated and used for reception in various combinations. When the elements are used to transmit and receive ultrasonic energy at frequencies in excess of 7 MHz, the physical dimensions of the individual elements can be quite small, with width ranging down to only a few thousandths of an inch. Additionally, the numbers of these finely dimensioned elements can be quite large, with numbers ranging, for example, from 128 elements to in excess of 380 elements. When the number of such piezoelectric elements is large and the physical dimension of the individual elements is small, considerable difficulty is encountered in accurately and reliably making the necessary electrical connections to the individual elements of the acoustic transducer.

According to one prior art method, an electrical lead is soldered to each piezoelectric element in an array by first preparing a surface area on the element to receive the lead. This is generally accomplished by depositing a thin layer of gold on a contact area of the piezoelectric element. The electrical lead is generally comprised of a thin copper strip that has been locally electroplated with a low melting point metal, such as indium, in a contact area of the lead. A flux compound is generally applied to either or both of the surfaces to be joined before the soldering operation. The flux material is required to substantially dissolve a thin film of oxides, or other contaminants that may exist on either of the metallic surfaces, or on the surface of the solder, that may interfere with the formation of metallic continuity between the gold surface on the element and the indium surface on the lead. The lead contact area is then positioned onto the gold contact area of the element, and soldered to the element by a thermal conduction method that generally interposes a eutectic solder alloy between the gold and indium metal layers.

A significant drawback present in the foregoing prior art method is the application of a high temperature heat conduction element to the connection to rapidly fuse the solder alloy to form the metallic connection. Since most transducer materials exhibit a sensitivity to elevated temperatures that potentially renders them vulnerable to damage at ordinary soldering temperatures, pulse reflow bonding machines have been widely used in the manufacture of transducer arrays. In pulse reflow bonding, a resistance thermode applies a pressing force to the connection and then rapidly raises the connection to the solder fusion temperature to form the required connection. The successful application of pulse reflow bonding to transducer manufacture requires, however, precise and uniform temperature control, as well as precise control of force applied to the thermode. Accordingly, pulse reflow bonding equipment constitutes a significant capital expenditure, thus increasing the cost of the completed assembly. Additionally, such equipment tends to be large, thus occupying a significant portion of the plant floor area.

An additional drawback present in the foregoing prior art method involves the post-soldering step of washing the remaining flux and various contaminants from the soldered connection. Since most commercially available fluxes are generally comprised of organic or inorganic acids or halogens, undesired concentrations of ionic compounds may remain on the soldered connection after the soldering process has been completed, which may eventually lead to corrosive damage of the connection. As a consequence, the soldered connection is usually subjected to a washing procedure to remove a substantial portion of these ionic contaminants. In washing the connection, water may be used, or various other organic solvents may be employed. As a consequence, the transducer array must be allowed to air-dry, or alternatively, be placed in a drying chamber before further processing of the element array takes place, thus incurring manufacturing delays. Further, the water used in the washing process may contain the various ionic contaminants, thus necessitating the removal of these contaminants from the water prior to disposal of the washing water into the wastewater disposal system.

Another problem associated with the prior art soldering method is ensuring that the gold surface areas remain free of various contaminants prior to the soldering operation. For example, prior to the soldering step, other structures, such as impedance-matching devices are added to the transducer array and they are attached using a variety of well-known adhesive compounds. Since the structures may be located near the gold surface areas on the elements, meticulous care must be taken to avoid the inadvertent spreading of the adhesive onto the gold surface areas during the joining process. If the adhesive spreads onto the gold surface areas, it must be removed, generally by mechanical means, which is followed by washing the affected area with an organic solvent, thus introducing undesired and meticulous rework of the array, before the soldering step occurs. Moreover, the additional handling incurred during rework operations of this kind may significantly enhance the likelihood of imparting physical damage to the array.

Other prior art methods have supplanted the soldering process described above with a variety of conductive adhesives. For example, U.S. Pat. No. 4,404,489 to Larson, et al. describes the use of a conductive epoxy to attach the electrical leads to the piezoelectric elements. Although this method avoids the use of thermal soldering processes, considerable care must still be exercised in the application of the epoxy during the assembly procedure since the conductive epoxy may form undesired conductive paths to adjacent elements or to grounded structures unless carefully applied.

Still other prior art method employ anisotropic, thermosetting conductive adhesives that contain small, conductive particles that, when compressed and subjected to heat, bond the electrical lead to the conductive pad. Although this method utilizes temperatures that are generally in the range of 80–100 deg. C., which are significantly below typical solder fusion temperatures, pulse reflow bonding equipment is generally utilized in order to apply the required heat and force to the bond, which necessitates a significant capital expenditure, as described above. In addition, the use of anisotropic conductive adhesives generally requires the application of somewhat higher forces to achieve acceptable bonding between the lead and the conductive pad, which generally requires that the application of force must be more carefully controlled, in order to avoid exceeding prescribed material limits.

SUMMARY OF THE INVENTION

The invention is directed towards an apparatus and method for forming electrical connections in an acoustic transducer wherein a non-conductive bonding material is interposed between a conductive surface on the transducer and a conductive lead that is coupled to a device that is capable of receiving and transmitting ultrasonic signals. In one aspect, the conductive surface is comprised of gold, and the conductive lead is comprised of copper that is plated with at least one metallic layer, that may be further comprised of an intermediate metal layer that is overlaid by a layer of gold. The intermediate layer may be further comprised of titanium, or alternatively, the intermediate layer may be comprised essentially of an alloy of nickel and chromium. A non-conductive bonding material is deposited on either the metallic layer on the lead or the conductive surface, which are joined to form a bonding interface. Electrical conduction at the interface is attained through a plurality of interfacial contact points that arise from the surface roughness inherent in the materials that project through the bonding interface and establish metallic contact. Alternatively, the interfacial contact points are impressed in the surfaces to augment the metallic contact. In another aspect, the electrical connections and the impedance matching layers are bonded to the piezoelectric material with the non-conductive bonding material at the same processing step to form a transducer array.

BRIEF DESCRIPTION OF THE DRAWINGS

FIG. 1(*b*) is a partial isometric view of a multi-element acoustic transducer array according to the prior art.

FIG. 1(*c*) is a partial cross-sectional view of an electrical lead connection to a multi-element acoustic transducer array according to the prior art.

DETAILED DESCRIPTION OF THE INVENTION

The present invention is generally directed to an apparatus and method for making electrical connections to acoustic transducers used in ultrasound systems. Many of the specific details of certain embodiments of the invention are set forth in the following description and in FIGS. 1 through 6 to provide a thorough understanding of such embodiments. One skilled in the art will understand, however, that the present invention may have additional embodiments, or that the present invention may be practiced without several of the details described in the following description.

Figure 1A:
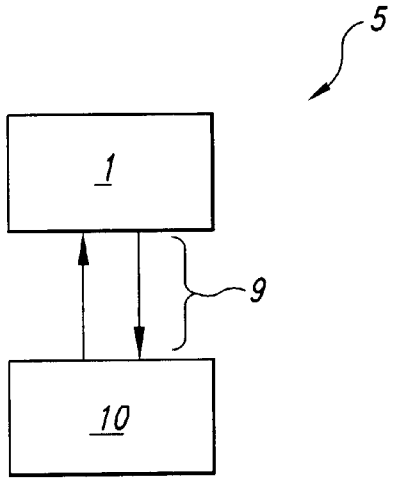
Fig. 1A (Prior Art)
FIG. 1(*a*) is a schematic view of an ultrasonic diagnostic imaging system.
Figure 1B:
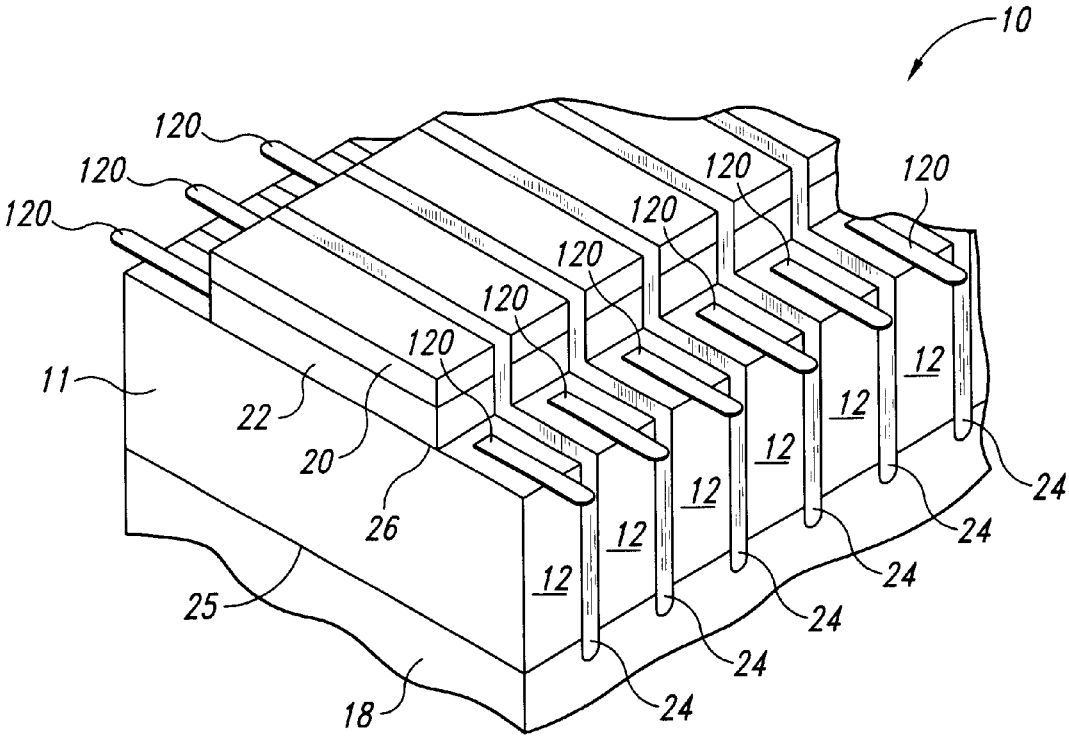
Fig. 1B (Prior Art)
Figure 1C:
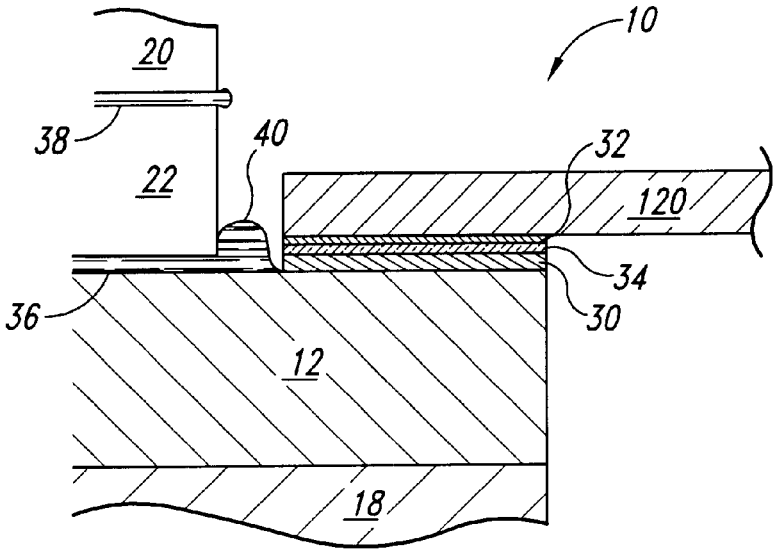
Fig. 1C (Prior Art)

FIG. 1(*a*) is a schematic view of an ultrasonic diagnostic imaging system according to the prior art. A signal transmission and reception device 1 generally includes an ultrasonic signal generation apparatus, and an ultrasonic signal reception apparatus, as well as other devices that process the received ultrasonic signals. The device 1 is electrically coupled to an acoustic transducer 10 by means of an electrical coupling 9 that permits signals to be exchanged between the transducer 10 and the transmission and reception device 1.

Referring to FIG. 1(*b*), the acoustic transducer 10 will be described in greater detail. As shown in FIG. 1(*b*), the multi-element ultrasonic transducer array 10 is generally formed from a bar, or block of a piezoelectric material 11 having a lower, generally planar surface 25 that is bonded to a backing member 18. The backing member 18 is generally comprised of a material with relatively low acoustic impedance and high acoustic attenuation, such as a filled-epoxy material, or a urethane composite. The piezoelectric material 11 also has a generally planar upper surface 26, upon which impedance matching layers 20 and 22 are mounted. The impedance matching layers 20 and 22 generally possess a thickness of one-quarter wavelength at the operating frequency of the device to enhance the transmission of energy between the high impedance piezoelectric material 11 and the relatively low impedance of body tissue. The impedance matching layers 20 and 22 are generally fixedly joined to each other, and to the piezoelectric material 11 by a suitable adhesive.

Still referring to FIG. 1(*b*), the unitary assembly of piezoelectric material 11, backing member 18 and impedance matching layers 20 and 22 are cut or diced into one or more rows of individual elements 12 to comprise the array 10. In a typical array, such as that shown in FIG. 1(*b*), the element-to-element spacing is generally referred to as the pitch of the array, while the spaces between the elements, formed by the cutting or dicing operation, are generally referred to as kerfs 24. The array elements 12 may be arranged in a linear configuration in which all of the elements 12 are in a single plane, as shown in FIG. 1(*b*). Alternatively, the elements 12 may be bent or curved to form a convex or concave array. The kerfs 24 may be filled with a filler material (not shown) that is generally a material with low acoustic impedance, in order to damp or block the transmission of acoustic vibrations between the elements 12. Alternatively, the kerfs 24 may be air-filled. In operation, the elements 12 are acoustically uncoupled and are free to vibrate independently.

Electrical contact with the individual elements 12 are provided by a plurality of electrical leads 120, which allow the elements 12 to be electrically coupled to a signal transmission and reception device (as shown in FIG. 1(*a*) ). Although FIG. 1(*b*) shows only the distal ends of the leads 120, one skilled in the art will understand that the leads 120 are generally comprised of leadframes, which contain a plurality of leads in a fixed pitch pattern. The leads 120 may also be comprised of the well-known methods of tape automated bonding (TAB), flex circuits, or alternatively, a unitary copper surface that is parted during the cutting or dicing operation. In the following discussion, it is understood that these well-known methods are equally applicable to the disclosed embodiments of the present invention.

Turning now to FIG. 1(*c*), the electrical contact between a lead 120 and an element 12 of the prior art array 10 will be described in greater detail. As shown therein, the lead 120, which is comprised of copper that has been electroplated with a layer 32 of indium or a tin-lead alloy at its distal end, is positioned over a gold layer 30 that has been deposited on the element 12. The lead 120 is then attached to the gold layer 30 on the element 12 by reflowing a solder layer 34 between the lead 120 and the gold layer to form a metallic bond. Prior to the soldering operation, however, the impedance matching layers 20 and 22 are bonded to the element 12 with adhesives that are applied between the interfacial layers 36 and 38 of the impedance matching layers 20 and 22. An undesired consequence of this bonding operation is the formation of adhesive bulges 40 that may encroach on the gold layer 30, thus necessitating removal of the adhesive and cleaning of the area, before soldering occurs.

Figure 2:
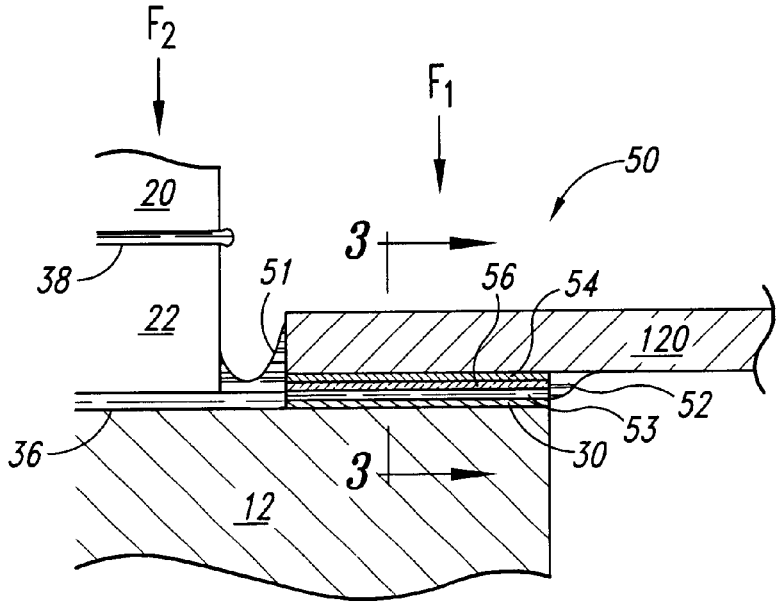
FIG. 2 is a partial cross-sectional view of a conductive lead connection to a multi-element acoustic transducer array according to an embodiment of the invention.
Figure 3:
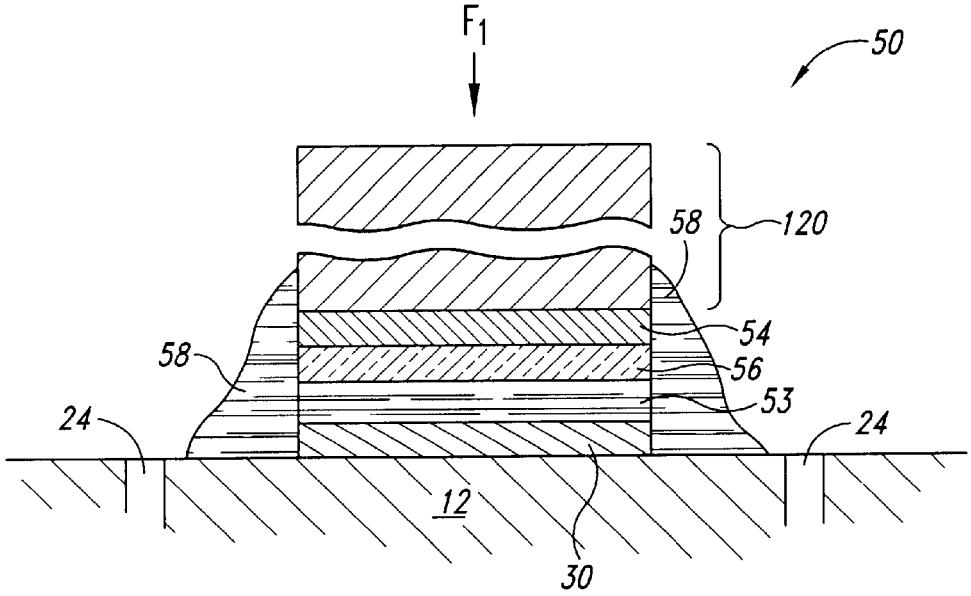
FIG. 3 is a partial cross-sectional view of a conductive lead connection to a multi-element acoustic transducer array according to an embodiment of the invention.

Turning now to FIGS. 2 and 3, a partial cross-sectional view of an electrical lead connection 50 to a multi-element acoustic transducer array according to an embodiment of the invention is shown. A conductive connecting lead 120 is positioned over a conductive connecting surface 30 that has been deposited on the element 12 by vapor deposition, or by other methods. The lead 120 is preferably formed from copper that has been electroplated with an intermediate layer 54 that is subsequently overlaid with a layer of gold 56. In one aspect of the invention, the intermediate layer 54 is comprised of a layer of titanium that is electroplated onto the connecting lead 120. In an alternate aspect, the intermediate layer 54 is comprised of a nickel-chromium alloy that is electroplated onto the electrical lead 120. The lead 120 is mechanically secured to the element 12 with a non-electrically conductive bonding material 53 that is interposed between the gold layer 56 and the connecting surface 30. A compressive force $F_1$ is then applied and sustained on the structure until the non-conductive bonding material 53 cures. The apparatus for impressing and controlling the compressive force on the connection 50 will be discussed in greater detail below. The bonding material 53 may be comprised of a non-conductive epoxy, or alternatively, a room temperature vulcanizing (RTV) adhesive material may be used.

Figure 4:
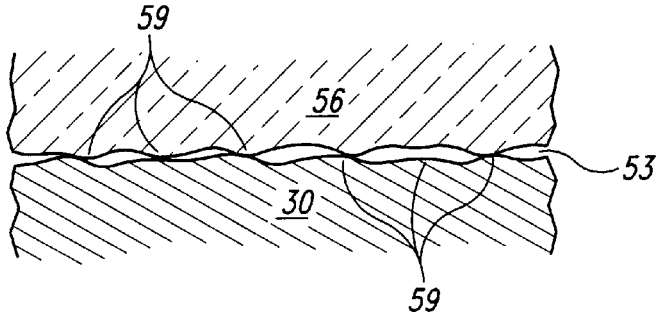
FIG. 4 is an enlarged cross-sectional view of the contact area in an embodiment of the invention.
Figure 5:
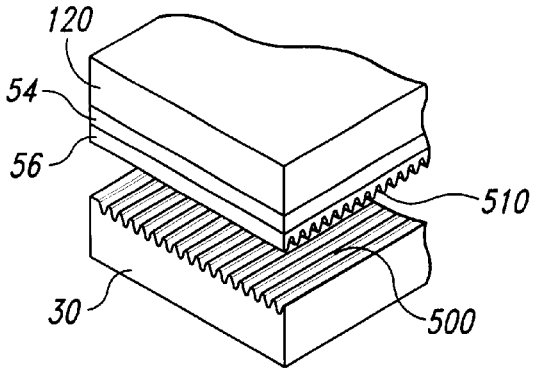
FIG. 5 is a partial isometric view of embossed surface features in an aspect of an embodiment of the invention.
Figure 6:
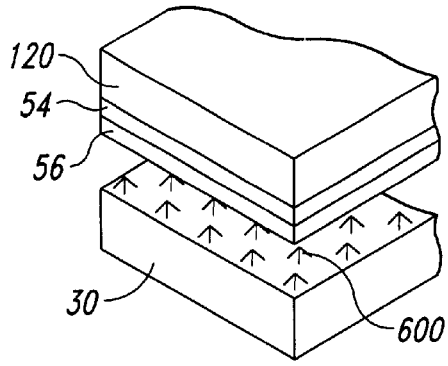
FIG. 6 is a partial isometric view of embossed surface features in still another aspect of an embodiment of the invention.

As best seen in FIG. 4, which shows a highly-enlarged partial cross sectional view of the interfacial region between layers 30 and 56, electrical continuity between these layers is achievable through a plurality of localized interfacial contact points 59 that arise due to the ordinary surface roughness present in the layers 30 and 56. The interfacial contact points 59 project through the non-conductive bonding material 53 in response to the application of the compressive force $F_1$ to establish metallic continuity between the layers 30 and 56. Alternatively, the formation of contact points 59 may be promoted by mechanically embossing the layers 30 and/or 56 with a pattern of protuberances to further promote the formation of the interfacial contact points 59. FIG. 5 shows a partial isometric view of embossed layers 30 and 56 according to an aspect of the invention where a pattern of striations 500 that are generally triangular in cross section are impressed in the conductive connecting surface 30. Similarly, gold layer 56 has a pattern of striations 510 that are also generally triangular in cross section, which are impressed into the surface 56. Preferably, the striations 500 and 510 are oriented perpendicularly, as shown. Alternatively, the striations 500 and 510 may be oriented at oblique angles, or the striations 500 or 510 may be embossed in only a single layer before assembly, or some other embossing may be used. FIG. 6 shows a partial isometric view of still another embossed layer 600 according to another aspect of the invention. As shown therein, the layer 30 includes a plurality of protuberances 600 that are approximately pyramidal in shape and extend outwardly from the surface of layer 30.

With reference still to FIGS. 5 and 6, the striations 500 and 510 may be impressed in the surfaces 30 and 56 by moving an embossing tool (not shown) against the layers 30 and 56 before assembly. The protuberances 600 may be formed in the surface 30 in a similar manner. Alternatively, other methods may be used to form the striations 500 and 510 and the protuberances 600. For example, the patterns may be formed by photolithography, or other well-known techniques.

Referring again to FIGS. 2 and 3, the bonding of the lead 120 onto the layer 30 preferably occurs when the impedance matching layers 22 and 20 are adhesively bonded to the piezoelectric element 120. Accordingly, the non-conductive bonding material 53 is applied concurrently to the interface 36 between the impedance matching layer 22 and the element 12, at the interface 38 between impedance matching layers 20 and 22, and between the layers 30 and 56, followed by application of the compressive force $F_1$ on the electrical connection 50. An additional compressive force $F_2$ is also applied to the impedance matching layers 20 and 22. Both compressive forces $F_1$ and $F_2$ are sustained until the non-conductive bonding material 53 cures. An apparatus for impressing and controlling the compressive forces will be discussed in greater detail below. Excess non-conductive material 53 that emerges from the interfaces 36 and 53 advantageously forms a fillet 51 substantially abutting the opposing surfaces of the lead 120 and the impedance matching layer 22, and an additional fillet 52 on the underside of the lead 120 that partially extends along a side of the element 12. The fillets 51 and 52 add significant mechanical strength to the lead connection 50. Referring now to FIG. 3, which shows a transverse cross sectional view (through section 3—3 as shown in FIG. 2) of the lead connection 50, additional fillets 58 are formed along the opposing side edges 59 of the lead connection 50 by excess non-conductive bonding material 53 that emerges from the interface between layers 30 and 56 in response to the application of the compressive force $F_1$ to the lead connection 50. The fillets 58 further advantageously augment the mechanical strength of the lead connection 50.

An important feature of the foregoing embodiment is that the electrical leads may be advantageously attached to the ultrasonic array without the requirement that the bonding material be carefully applied. As an example, when conductive bonding materials are used, as described in the prior art, care must be exercised during the application of the material that no unintended electrical connections are formed with adjacent elements, or other structures, by bridging or smearing the material between the elements or structure. This feature will permit the production of arrays to be accelerated by dispensing with the requirement that the bonding material be meticulously applied.

Figure 7:
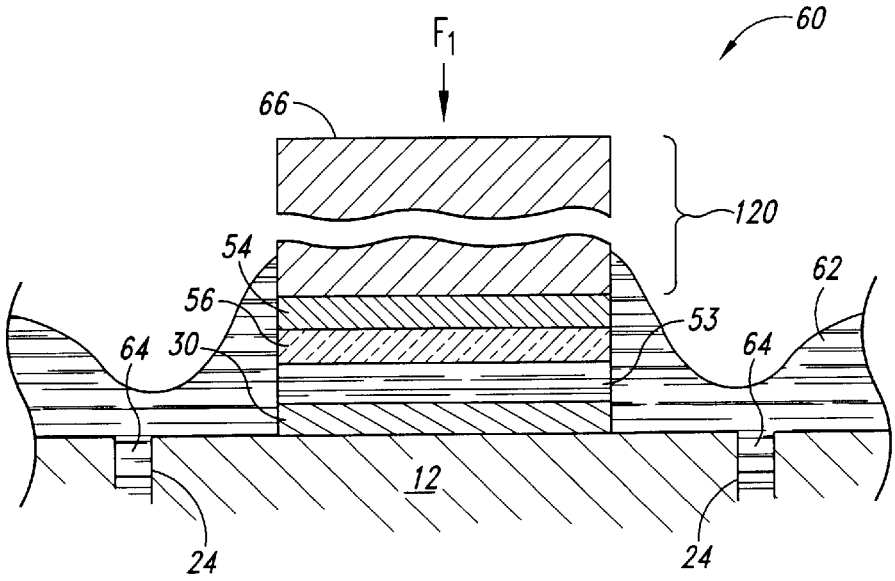
FIG. 7 is a partial cross-sectional view of a conductive lead connection to a multi-element acoustic transducer array according to an alternate embodiment of the invention.

With reference now to FIG. 7, a partial transverse cross-sectional view of an electrical lead connection 60 to a multi-element acoustic transducer array according to an alternative embodiment of the invention is shown. In this view, the leadframe connection 60 is viewed through the same sectional view 3—3 as shown in FIG. 2. As shown therein, a connecting lead 120 that has been first electroplated with an intermediate layer 54 is positioned onto a connecting surface 30 that has been deposited onto the piezoelectric element 12. As in previous embodiments, the intermediate layer 54 may be comprised of a layer of titanium that has been electroplated onto the lead 120, or in an alternative aspect, the intermediate layer 54 may be comprised of a nickel-chromium alloy that has been electroplated onto the lead 120. A non-electrically conductive bonding material 53 is interposed between the gold layer 56 and the connecting surface 30 on the element 12, followed by the application of a compressive force $F_1$. The force $F_1$ is applied and sustained on the structure until the non-conductive bonding material 53 cures. In this embodiment, however, sufficient non-conductive bonding material 53 is applied to permit the material to extend downward into the kerfs 24, substantially filling the kerfs 24 with non-conductive epoxy, thus forming acoustic isolators 64 between adjacent piezoelectric elements 12. In still another alternative aspect of this embodiment, the fillets 62 may be comprised of a greater volume of non-conductive bonding material 53 such that the fillets 62 are increased in size and extend over the top surface 66 of the lead 120 and join to form a layer of non-conductive bonding material 53 that fully encapsulates the lead 120.

Figure 8:
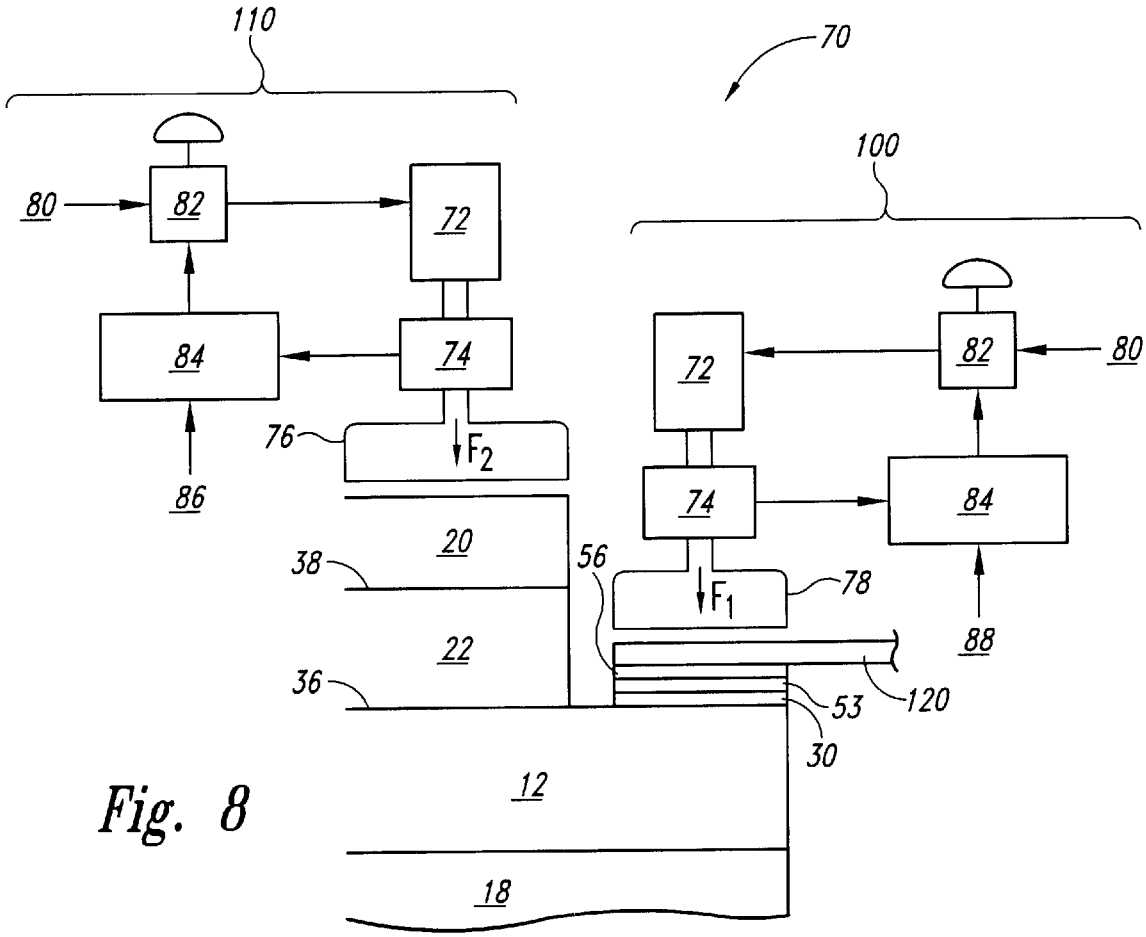
FIG. 8 is a partial cross-sectional view illustrating the assembly of an electrical leadframe connection to a multi-element acoustic transducer array according to an aspect of the invention.

Turning now to FIG. 8, a partial schematic view of an assembly apparatus 70 for the bonding of electrical lead connections and impedance matching layers to a transducer array will now be described. Since the non-conductive bonding material 53 used in the disclosed embodiments is generally a significantly viscous and non-Newtonian thixotropic paste, an apparatus to steadily and uniformly control the application of the compressive forces $F_1$ and $F_2$ to the ultrasonic transducer array is required due to the observed tendency of the material to slowly creep from the interfaces when a force is applied. As a result, the transducer array may be inadvertently damaged through an excessive, or unregulated application of compressive forces during the bonding process unless the application of force is controlled. Alternatively, if too little force is applied, the lead 120 may fail to make sufficient metallic contact with the layer 30 on the element 12 before the non-conductive material 53 cures, resulting in a non-operating connection. Referring still to FIG. 8, the apparatus is comprised of a first force regulation apparatus 100 that is operative to apply a compressive force $F_1$ in a controlled manner to the leadframe 120 after the non-conductive bonding material 53 has been applied to the interface between layers 56 and 30. A second force regulating apparatus 110 is similarly operative to apply a compressive force $F_2$ to the impedance matching layers 20 and 22 following the application of the non-conductive epoxy at the interfaces 36 and 38. The first force regulating apparatus 100 is comprised of a first anvil 78 that is positioned on the lead 120, and is structured to transfer the compressive force $F_1$ to the lead connection in a uniform manner. The second force regulating apparatus 110 is similarly comprised of a second anvil 76 that is structured to transfer the compressive force $F_2$ to the impedance matching layers 20 and 22 in a uniform manner. The first force regulating apparatus 100 and the second force regulating apparatus 110 are further comprised of actuators 72 that provide the compressive forces $F_1$ and $F_2$ to the anvils 78 and 76, respectively. Preferably, the actuators 72 consist of pneumatically actuated piston-cylinder devices, however, other well-known linear actuation means are available. The actuators 72 are mechanically coupled to force sensors 74, which are positioned between the actuators 72 and the anvils 78 and 76 to measure the forces applied by the actuators 72. The force sensors 74 are coupled to control systems 84 that receive signals from the force sensors 74, and transmit signals to actuation valves 82. The actuation valve 82 is coupled to a source of a pressurized fluid 80, which controls the amount of the pressurized fluid 80 released to the actuators 72. The actuators 72, force sensors 74, control systems 84 and actuation valves 82 thus operate cooperatively to form a closed feedback load regulation system wherein the compressive forces $F_1$ and $F_2$ are independently regulated by individual compressive force set point values 88 and 86, respectively.

The foregoing embodiments advantageously provide a means for reliably and repeatably attaching electrical leads to acoustic transducers used in ultrasound scanheads. Since the foregoing embodiments allow the attachment of leads to the transducer elements with a non-conductive bonding material, the leads may be attached at ordinary ambient temperatures, thus eliminating the need to expose the array to potentially damaging temperatures, as required in conventional soldering processes. Moreover, the attachment of the leads as disclosed in the foregoing embodiments eliminates the need for soldering flux, thus eliminating the post-soldering washing requirement, as well as lead waste. Further, since the disclosed embodiments do not require the deposition of an indium layer on the leadframes, the cost associated with this expensive material is advantageously avoided. Still further, since the various disclosed embodiments do not require any thermal processing, the requirement for expensive pulse bonding equipment is avoided.

Additionally, the foregoing embodiments advantageously allow electrical leads to be attached to an ultrasonic array without the requirement that the application of the bonding material be carefully controlled. For example, when conductive bonding materials are used, care must be exercised during the application of the material that no unintended electrical connections are formed with adjacent elements, or other structures, by bridging or smearing the material between the elements or structure. This feature will permit the production of arrays to be accelerated by dispensing with the requirement that the bonding material be meticulously applied.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope the invention, as those skilled in the relevant art will recognize. Moreover, the various embodiments described above can be combined to provide further embodiments. Accordingly, the invention is not limited by the disclosure, but instead the scope of the invention is to be determined entirely by the following claims.

What is claimed is:

1. An ultrasonic transducer assembly, comprising:

a plurality of piezoelectric transducer elements;

a transmission and reception device adapted to transmit electrical signals to the elements and receive electrical signals from the elements; and a plurality of conductive connecting leads adapted to electrically couple individual transducer elements to respective points of the transmission and reception device, each of the connecting leads having an intermediate layer deposited on the lead that at least partially overlays the lead and a metallic layer deposited on the intermediate layer, the connecting leads being fixedly and conductively attached to a conductive connecting surface on the element with an electrically non-conductive bonding material interposed between the connecting lead and the connecting surface.

2. The assembly according to claim 1, wherein the conductive connecting surface is further comprised of a metallic surface overlaying at least a part of the element.

3. The metallic surface according to claim 2, wherein the layer is further comprised of gold.

4. The assembly according to claim 1, wherein the conductive connecting leads are further comprised of copper.

5. The assembly according to claim 1, wherein the transducer elements are comprised of lead zirconate titanate.

6. The assembly according to claim 1, wherein the intermediate layer is further comprised of titanium.

7. The assembly according to claim 1, wherein the intermediate layer is further comprised essentially of nickel and chromium.

8. The assembly according to claim 1, wherein the connecting leads are further comprised of a gold layer deposited on the intermediate layer.

9. The assembly according to claim 1, wherein the conductive connecting leads are further comprised of a plurality of unitarily fabricated tape automated bonding conductors.

10. The assembly according to claim 1, wherein the conductive connecting leads are further comprised of a plurality of unitarily fabricated flex circuits.

11. The assembly according to claim 1, wherein the conductive connecting leads and the connecting surface each have a plurality of raised surface features that protrude through the non-conductive bonding material to establish conductive contact.

12. The assembly according to claim 11, wherein the raised features comprise a plurality of generally parallel striations on the conductive connecting leads and the connecting surface, the striations on the connecting leads being oriented approximately perpendicularly to the striations on the connecting surface.

13. The assembly according to claim 12, wherein the striations on the connecting leads are oriented at an oblique angle relative to the striations on the connecting surface.

14. The assembly according to claim 1, wherein the conductive connecting leads have a plurality of raised surface features that protrude through the non-conductive bonding material to establish conductive contact with the connecting surface.

15. The assembly according to claim 14, wherein the plurality of raised features comprise a plurality of generally parallel striations.

16. The assembly according to claim 14, wherein the plurality of raised features comprise a plurality of approximately pyramidal shapes.

17. The assembly according to claim 1, wherein the conductive connecting surfaces have a plurality of raised surface features that protrude through the non-conductive bonding material to establish conductive contact with the connecting leads.

18. The assembly according to claim 17, wherein the plurality of raised features comprise a plurality of generally parallel striations.

19. The assembly according to claim 17, wherein the plurality of raised features comprise a plurality of approximately pyramidal shapes.

20. The assembly according to claim 1, wherein the electrically non-conductive bonding material is comprised of a non-conductive epoxy.

21. The assembly according to claim 1, wherein the electrically non-conductive bonding material is comprised of a room temperature vulcanizing (RTV) material.

22. The assembly according to claim 1, wherein the transducer elements are comprised of barium titanate.

23. A method of forming an ultrasonic transducer array, comprising:

parting a unitary piezoelectric block to form a plurality of piezoelectric transducer elements, the elements being separated from each other by a plurality of substantially parallel kerfs, the elements having surfaces adapted to receive a plurality of impedance matching layers;

applying a conductive layer to a surface of each piezoelectric transducer element to form a conductive connecting surface;

depositing intermediate layers to a portion of a plurality of conductive leads and applying a metal surface layer to the intermediate layers;

applying a non-conductive bonding material to either the plurality of conductive leads or the conductive connective surfaces;

distributing the non-conductive bonding material onto either the impedance matching layer or the surface adapted to receive the impedance matching layer;

joining the plurality of conductive leads to the conductive connecting surfaces to form first bonding interfaces;

combining the impedance matching layers with the surfaces adapted to receive the impedance matching layers to form second bonding interfaces; and impressing a compressive force to the first and second bonding interfaces until the bonding material cures.

24. An ultrasonic transducer assembly, comprising:

a plurality of piezoelectric transducer elements, each having an upper surface and a lower surface and being fixedly joined to a backing member at the lower surface, and having at least one impedance matching layer fixedly attached to the upper surface;

a transmission and reception device structured to transmit electrical signals to the elements and receive electrical signals from the elements; and a plurality of conductive connecting leads to electrically connect each transducer element to a respective point of the transmission and reception device, each connecting lead being at least partially overlaid by an intermediate layer and having a metallic layer deposited on the intermediate layer, the connecting leads being conductively and mechanically attached to a conductive connecting surface on the element with an electrically non-conductive bonding material that at least partially forms a layer between the connecting lead and the connecting surface.

25. The assembly according to claim 24, wherein the conductive connecting surface is comprised of a gold layer deposited on the element.

26. The assembly according to claim 24, wherein the conductive connecting leads are comprised of copper.

27. The assembly according to claim 24, wherein the intermediate metallic layer is comprised of titanium.

28. The assembly according to claim 24, wherein the intermediate metallic layer is comprised of an alloy consisting essentially of nickel and chromium.

29. The assembly according to claim 24, wherein the conductive connecting leads are comprised of a gold layer deposited on the intermediate layer.

30. The assembly according to claim 24, wherein the conductive connecting leads and the connecting surface each have a plurality of raised surface features that are impressed on the leads and the surface that protrude through the non-conductive bonding material to establish conductive contact.

31. The assembly according to claim 30, wherein the plurality of raised features comprise a plurality of generally parallel striations on the conductive connecting leads and the connecting surface, the striations on the connecting leads being oriented approximately perpendicularly to the striations on the connecting surface.

32. The assembly according to claim 31, wherein the plurality of raised features comprise generally parallel striations on the connecting leads that are oriented at an oblique angle relative to the striations on the connecting surface.

33. The assembly according to claim 24, wherein the conductive connecting leads are comprised of a plurality of raised surface features that are impressed on the leads that protrude through the non-conductive bonding material to establish conductive contact with the connecting surface.

34. The assembly according to claim 33, wherein the raised surface features comprise a plurality of generally parallel striations.

35. The assembly according to claim 33, wherein the raised surface features comprise a plurality of approximately pyramidal shapes.

36. The assembly according to claim 24, wherein the conductive connecting surfaces are comprised of a plurality of raised surface features that are impressed on the surfaces that protrude through the non-conductive bonding material to establish conductive contact with the connecting leads.

37. The assembly according to claim 36, wherein the raised surface features comprise a plurality of generally parallel striations.

38. The assembly according to claim 36, wherein the raised surface features comprise a plurality of approximately pyramidal shapes.

39. The assembly according to claim 24, wherein the conductive connecting leads are comprised of a plurality of unitarily fabricated tape automated bonding conductors.

40. The assembly according to claim 24, wherein the conductive connecting leads are comprised of a plurality of unitarily fabricated flex circuits.

41. The assembly according to claim 24, wherein the electrically non-conductive bonding material is comprised of a non-conductive epoxy.

42. The assembly according to claim 24, wherein the electrically non-conductive bonding material is comprised of a room temperature vulcanizing (RTV) material.

43. The assembly according to claim 24, wherein the transducer elements are comprised of barium titanate.

44. The assembly according to claim 24, wherein the transducer elements are comprised of lead zirconate titanate.

45. The assembly according to claim 24, wherein the at least one impedance matching layer is bonded to the elements with the electrically non-conductive bonding material.

46. The assembly according to claim 24, wherein the electrically non-conductive bonding material further forms fillets to mechanically reinforce the lead attachment.

47. The assembly according to claim 24, wherein the layer formed by the electrically non-conductive bonding material further extends over the connecting lead to encapsulate the lead.

48. The assembly according to claim 24, wherein the plurality of piezoelectric transducer elements is further comprised of kerfs separating each element that extend upwardly from the backing member to the upper surface of each element.

49. The assembly according to claim 48, wherein the kerfs are substantially filled with the electrically non-conductive bonding material.

50. A method for fixedly and conductively attaching a conductive connecting lead to a piezoelectric transducer element, comprising:

applying a metallic layer to a surface of the piezoelectric transducer element to form a conductive connecting surface;

depositing an intermediate layer on a base metal of the lead, and applying a metal surface layer to the intermediate layer;

applying a non-conductive bonding material to either the conductive connecting lead or the conductive connecting surface;

positioning the connecting lead on the conductive connecting surface to form a bonding interface; and applying a compressive force to the bonding interface until the bonding material cures.

51. The method according to claim 50, wherein the step of applying a compressive force to the bonding interface is comprised of regulating the application of the force to conform to a setpoint value.

52. The method according to claim 50, wherein the step of applying a metallic layer to a surface of the piezoelectric transducer element is comprised of applying a layer of gold on the element.

53. The method according to claim 50, wherein the step of depositing a metallic intermediate layer is comprised of depositing a layer of titanium on a base metal consisting of copper.

54. The method according to claim 50, wherein the step of depositing a metallic intermediate layer is further comprised of depositing a layer of metal consisting essentially of nickel and chromium on a base metal consisting of copper.

55. The method according to claim 50, wherein the step of applying a metal surface layer is further comprised of applying a layer of gold to the intermediate layer.

56. The method according to claim 50, wherein the step of applying a non-conductive bonding material is comprised of applying a non-conductive epoxy to either the conductive connecting lead or the conductive connecting surface.

57. The method according to claim 50, wherein the step of applying a non-conductive bonding material is further comprised of applying a room temperature vulcanizing (RTV) material to either the conductive connecting lead or the conductive connecting surface.

58. The method according to claim 23, wherein the step of distributing the non-conductive bonding material is further comprised of distributing a non-conductive epoxy to either the impedance matching layer or the surface adapted to receive the impedance matching layer.

59. The method according to claim 23, wherein the step of distributing the non-conductive bonding material is further comprised of distributing a room temperature vulcanizing (RTV) material to either the impedance matching layer or the surface adapted to receive the impedance matching layer.

60. The method according to claim 23, wherein the step of impressing a compressive force is further comprised of impressing a first compressive force to the first bonding interfaces, and a second compressive force to the second bonding interfaces.

61. The method according to claim 60, wherein the step of impressing a first compressive and a second compressive force is further comprised of regulating the application of the first compressive force and second compressive force to conform to a first and a second setpoint value.

62. The method according to claim 23, wherein the step of depositing an intermediate layer onto the leads is further comprised of depositing a layer of titanium onto the leads.

63. The method according to claim 23, wherein the step of depositing an intermediate layer onto the leads is further comprised of depositing a layer of an alloy consisting essentially of nickel and chromium onto the leads.

64. The method according to claim 23, wherein the step of depositing at least one metallic layer onto a plurality of conductive leads is further comprised of depositing an intermediate layer onto the leads that is overlaid with a metallic surface layer.

65. The method according to claim 23, wherein the step of depositing an intermediate layer onto the leads that is overlaid with a metallic surface layer is further comprised of depositing a gold surface layer onto the intermediate layer.

66. The method according to claim 23, wherein the step of applying a conductive layer to a surface of each piezoelectric transducer element is further comprised of applying a layer of gold to a surface of each element.

67. The method according to claim 23, wherein the step of applying a non-conductive bonding material to either the plurality of conductive leads or the conductive connective surfaces is further comprised of applying the bonding material to both the conductive leads and the connective surface.

68. The method according to claim 23, wherein the step of distributing the non-conductive bonding material onto the surface adapted to receive the impedance matching layer is further comprised of directing non conductive bonding material into the kerfs separating the elements to form acoustic attenuating layers separating the elements.

69. The method according to claim 23, wherein the step of joining is further comprised of directing the non conductive bonding material to form reinforcing fillets.

70. The method according to claim 23, wherein the step of applying a non-conductive bonding material is further comprised of applying a non-conductive epoxy to either the plurality of conductive leads or the conductive connecting surface.

71. The method according to claim 23, wherein the step of applying a non-conductive bonding material is further comprised of applying a room temperature vulcanizing (RTV) material to the plurality of conductive leads or the conductive connecting surface.

* * * * *

UNITED STATES PATENT AND TRADEMARK OFFICE

CERTIFICATE OF CORRECTION

PATENT NO. : 6,490,228 B2
DATED : December 3, 2002
INVENTOR(S) : Donald Gilbert Killam It is certified that error appears in the above-identified patent and that said Letters Patent is hereby corrected as shown below:

Column 3,
Line 9, delete "prior art method" and insert -- prior art methods --

Column 13,
Lines 20 and 23, delete "depositing an intermediate layer onto the leads is further" and insert -- depositing intermediate layers is further --
Lines 27 and 28, delete "depositing at least one metallic layer onto a plurality of conductive leads is further" and insert -- depositing intermediate layers is further --
Lines 31 and 32, delete "to claim 23, wherein the step of depositing an intermediate layer onto the leads that is" and insert -- to claim 64, wherein the step of depositing an intermediate layer that is --

Signed and Sealed this

Nineteenth Day of October, 2004

JON W. DUDAS
*Director of the United States Patent and Trademark Office*